US008038729B2

(12) United States Patent
Hodge et al.

(10) Patent No.: US 8,038,729 B2
(45) Date of Patent: Oct. 18, 2011

(54) LIQUID FABRIC CONDITIONER COMPOSITION AND METHOD OF USE

(75) Inventors: Charles A. Hodge, Cottage Grove, MN (US); Julio R. Panama, Blaine, MN (US); Amanda Blattner, Prior Lake, MN (US); Nicholas Popp, Minneapolis, MN (US); David W. Gohl, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 300 days.

(21) Appl. No.: 12/138,021

(22) Filed: Jun. 12, 2008

(65) Prior Publication Data

US 2008/0307586 A1 Dec. 18, 2008

Related U.S. Application Data

(60) Provisional application No. 60/934,752, filed on Jun. 15, 2007.

(51) Int. Cl.
*D06M 13/325* (2006.01)
*D06M 15/643* (2006.01)

(52) U.S. Cl. ..... 8/137; 8/115.6; 252/8.86; 510/267

(58) Field of Classification Search ..... 8/115.6, 8/137; 252/8.84, 8.85, 8.86; 510/276
See application file for complete search history.

(56) References Cited

U.S. PATENT DOCUMENTS

| | | | | |
|---|---|---|---|---|
| 3,257,739 | A * | 6/1966 | Wentz | 34/493 |
| 4,218,359 | A | 8/1980 | Marwitz et al. | |
| 4,292,362 | A | 9/1981 | Marwitz et al. | |
| 4,446,033 | A | 5/1984 | Barrat et al. | |
| 4,661,267 | A | 4/1987 | Dekker et al. | |
| 4,661,269 | A | 4/1987 | Trinh et al. | |
| 4,724,089 | A | 2/1988 | König et al. | |
| 4,800,026 | A | 1/1989 | Coffindaffer et al. | |
| 4,806,255 | A | 2/1989 | König et al. | |
| 4,818,242 | A | 4/1989 | Burmeister et al. | |
| 5,064,544 | A | 11/1991 | Lin et al. | |
| 5,593,611 | A | 1/1997 | Czech | |
| 5,830,845 | A | 11/1998 | Trinh et al. | |
| 5,977,055 | A | 11/1999 | Trinh et al. | |
| 6,306,814 | B1 * | 10/2001 | Appel et al. | 510/446 |
| 6,547,981 | B2 | 4/2003 | Messner et al. | 252/8.61 |
| 6,576,606 | B2 | 6/2003 | Richards, III et al. | 510/475 |
| 6,737,390 | B2 * | 5/2004 | Sunder et al. | 510/298 |
| 6,737,392 | B1 * | 5/2004 | Keys et al. | 510/330 |
| 6,884,767 | B1 | 4/2005 | Frankenbach et al. | |
| 6,903,061 | B2 | 6/2005 | Masschelein et al. | |
| 7,049,276 | B2 | 5/2006 | Altmann et al. | |
| 7,056,879 | B2 | 6/2006 | Wang et al. | |
| 7,108,725 | B2 | 9/2006 | Caswell et al. | |
| 7,144,431 | B2 | 12/2006 | Gardner et al. | 8/115.6 |
| 7,205,270 | B2 | 4/2007 | Delplancke et al. | |
| 2002/0193272 | A1 | 12/2002 | Clarkson et al. | |
| 2005/0009720 | A1 | 1/2005 | Delplancke et al. | |
| 2005/0164900 | A1 | 7/2005 | Masschelein et al. | |
| 2005/0170994 | A1 | 8/2005 | Casado-Dominguez et al. | |
| 2005/0197269 | A1 | 9/2005 | Graydon et al. | |
| 2005/0197279 | A1 | 9/2005 | Graydon et al. | |
| 2006/0037150 | A1 * | 2/2006 | Offord et al. | 8/115.51 |
| 2006/0293213 | A1 | 12/2006 | Uehara et al. | |

FOREIGN PATENT DOCUMENTS

| | | |
|---|---|---|
| DE | 102004034266 | 2/2006 |
| EP | 885283 | 11/2001 |
| EP | 1075864 | 1/2005 |
| EP | 1095128 | 4/2005 |
| EP | 1561806 | 8/2005 |
| EP | 1075503 | 11/2005 |
| EP | 1167456 | 11/2005 |
| EP | 1558718 | 9/2007 |
| EP | 1561804 | 8/2008 |
| KR | 10-1991-0000055 B1 | 1/1991 |
| WO | WO01/25384 | 4/2001 |
| WO | WO2005075618 | 8/2005 |
| WO | WO2005075620 | 8/2005 |
| WO | WO2005105969 | 11/2005 |
| WO | WO2005105970 | 11/2005 |

OTHER PUBLICATIONS

JK Wacker, "*Wacker® FC 201 Fabric Care Silicone Emulsion*", product bulletin, Version 1.1; Jun. 12, 2005, 1 page.

JK Wacker, "*Wacker® FC 203 Multifunctional Silicone Fluid*", product bulletin, Version 1.1; Jun. 12, 2005, 1 page.

JK Wacker, "*Wacker® FC 205 Fabric Care Silicone Emulsion*", product bulletin, Version 1.1; Jun. 12, 2005, 1 page.

Stepan Company, "*Accosoft® 501*", product bulletin, Oct. 2001, 2 pages.

Stepan Company, "*Stepantex® VT 90*", product bulletin, May 2003, 2 pages.

* cited by examiner

*Primary Examiner* — Amina Khan
(74) *Attorney, Agent, or Firm* — Andrew D. Sorenson; Laura C. Dilorenzo; Amy J. Hoffman

(57) ABSTRACT

The invention includes a method of conditioning fabrics, comprising contacting fabric with a liquid composition comprising an amino-functional silicone and a quaternary ammonium, and drying said fabric at 200 degrees F. or greater. The invention includes a method of conditioning fabrics, comprising washing fabric in a detergent having a wash pH of greater than 10, contacting fabric with a liquid composition comprising an amino-functional silicone and a quaternary ammonium, and drying said fabric at less than 200 degrees F. The invention further provides a method of conditioning fabrics wherein softness, anti-static, and anti-wrinkle properties are imparted to the fabric wherein the conditioned fabric resists yellowing in industrial and institutional conditions wherein the wash pH is greater than 9 and/or the fabric temperature is 200 degrees Fahrenheit or greater.

8 Claims, 1 Drawing Sheet

LIQUID FABRIC CONDITIONER COMPOSITION AND METHOD OF USE

RELATED APPLICATION

This application claims priority to U.S. Provisional Application No. 60/934,752 filed Jun. 15, 2007; entitled, "Liquid Fabric Conditioner Composition and Method of Use."

FIELD OF THE INVENTION

The present invention relates to a method for treating a textile under industrial and institutional fabric care conditions to impart softness with reduced yellowing. More particularly, the present invention relates to a method for treating a textile with a fabric conditioning composition comprising an amino-functional silicone and a quaternary ammonium.

BACKGROUND OF THE INVENTION

It has become commonplace today in the consumer and residential sector to use fabric softening compositions comprising major amounts of water, lesser amounts of fabric softening agents, and minor amounts of optional ingredients such as perfumes, colorants, preservatives and stabilizers. Such compositions are aqueous suspensions or emulsions that are conveniently added to the rinsing bath of residential washing machines to improve the hand of the laundered fabrics.

It is an entirely different situation, however, to find similarly acting liquid fabric softening compositions that are effective in the harsher conditions found in industrial and institutional settings without imparting negative effects on the fabric. That is, in the industrial sector fabric softening agents generally cause undue premature yellowing of the fabrics. By the term, "industrial and institutional" it is meant that the operations are located in the service industry including but not limited to hotels, motels, hospitals, nursing homes, restaurants, health clubs, and the like. Due to a number of factors, fabric is exposed to considerably harsher conditions in the industrial and institutional setting as compared to the consumer or residential sector. In the industrial and institutional sector, soil levels found in the linens are much higher than that in the residential or consumer sector. As such, detergents used in the industrial and institutional settings are more alkaline as compared to those in the consumer sector that are less alkaline. Wash cycles in the residential sector have a pH of near neutral whereas the wash cycles in the industrial and institutional sector have a pH of greater than about 9.

Another factor that contributes to the overall differences in operating conditions between consumer laundry and that in the industrial and institutional setting is the high volume of laundry that must be processed in shorter times in the industrial and institutional sector than allowed in the consumer market. Dryers in such operations operate at substantially higher temperatures than those found in the consumer or residential market. It is expected that industrial or commercial dryers operate at levels to provide fabric temperatures that are typically provided in the range of between about 180 degrees Fahrenheit and about 270 degrees F., whereas consumer or residential dryers often operate at maximum fabric temperatures of between about 120 degrees F. and about 160 degrees F. It should be understood that the temperature of the consumer or residential dryer is often changed depending upon the item being dried. Even so, residential dryers do not have the capacity to operate at the elevated temperatures found in the industrial and institutional sector. Industrial and institutional dryers operate in the range of about 180 degrees up to about 270 degrees Fahrenheit, more preferably, about 220 degrees up to about 260 degrees F., and most preferably about 240 degrees up to about 260 degree Fahrenheit maximum fabric temperature.

Many different types of fabric softening agents are used in commercially available fabric softeners intended for the residential or consumer market. These include quaternary ammoniums. Fabric softeners containing quaternary ammoniums operate quite well in the near neutral pH wash and lower dryer temperature conditions of the residential market. Softeners containing quaternary ammonium compounds impart softness to the laundry and are non-yellowing in the residential and consumer sector. These traits are a highly desired combination of properties for textiles such as fibers and fabrics, both woven and non-woven. By softness is meant the quality perceived by users through their tactile sense to be soft. Such tactile perceivable softness may be characterized by, but not limited to resilience, flexibility, fluffiness, slipperiness, and smoothness and subjective descriptions such as "feeling like silk or flannel."

In contrast, Applicants discovered that the quaternary ammonium compounds, when used in the harsher conditions found in the industrial and institutional sector, caused unacceptable yellowing of the fabric. The majority of the linens in the institutional and industrial sector are white. As can be expected, such yellowing is much more apparent with white linens. The yellowing gives the linens an unclean or unsavory appearance at best. As such, the use of quaternary ammonium fabric conditioners which cause yellowing may provide a nice feel, but shorten the overall life of a linen because the linen must be discarded before its otherwise useful life is exhausted. In the case of colored linens, yellowing is less obvious but the quaternary ammonium compounds cause a dulling of the colors over time. It is easily appreciated that it is desirable to provide a fabric conditioning agent that does not cause significant yellowing or dulling of fabrics that are repeatedly washed and dried. Moreover, it is generally desirable for white laundry that is dried to remain white even after multiple drying cycles. That is, it is desirable that the fabric not yellow or dull after repeated cycles of drying in the presence of the fabric conditioning composition.

Applicants found that in the higher alkalinity and higher temperature conditions of the industrial and institutional sector the addition of amino silicone or amino-functional silicone to quaternary ammonium containing fabric conditioning composition did not alter certain fabric conditioning properties. Surprisingly, Applicants found that the combination of components in the fabric conditioning composition exhibit reduced yellowing or dulling of the laundry in industrial and institutional conditions without adversely affecting the softening properties.

It is known in the art to include anti-wrinkling agents to provide anti-wrinkling properties. Exemplary anti-wrinkling agents can include siloxane or silicone containing compounds. While it is known in the art to include silicones in fabric conditioning compositions to aid in anti-wrinkling, it has not previously been known to add silicones having amino functional groups for use in high temperature dryers such as found in industrial and institutional settings. Moreover, it has not been known to add amino functional silicones to fabric conditioning compositions in order to reduce the yellowing of fabrics often experienced in the industrial and institutional sector due to the extreme conditions. It has also not been known to include silicones in fabric conditioning compositions in order to reduce yellowing of fabrics when using high alkaline detergents.

Fabric conditioning or fabric softening compositions are delivered via various methods. Liquid softeners are common in the residential market as are dryer sheets. Yet another method of delivery is via solid block. While all delivery methods work to deliver softening agents to the fabric, it is believed that liquid delivery methods lead to higher levels of deposition of the softening agents on the fabric. With higher levels of the softening agents there is an increased opportunity for yellowing to occur.

SUMMARY OF THE INVENTION

This invention relates to compositions and methods for conditioning fabrics during the rinse cycle of industrial or institutional laundering operations. The compositions of the invention are used in such a manner to impart to laundered fabrics a texture or hand that is smooth, pliable and fluffy to the touch (i.e., soft) and also to impart to the fabrics a reduced tendency to pick up and/or retain an electrostatic charge (i.e. static control), and to reduce discoloring often referred to as yellowing, especially when the fabrics are washed in a high alkaline detergent and/or dried in an automatic dryer at industrial and institutional conditions.

This invention relates to liquid fabric care compositions or fabric conditioner compositions comprising an amine functional silicone compound and a quaternary ammonium compound for use in an industrial and institutional fabric care operation. The invention further relates to a method of treating fabric comprising conditioning the fabric with a composition comprising an amine functional silicone compound and a quaternary ammonium compound in an industrial and institutional fabric care operation.

Surprisingly, the method of the present invention imparts softness at least equivalent to commercial or residential softeners and provides the additional benefit of being non-yellowing and/or having a reduced tendency to discolor the treated textile over multiple wash/dry cycles. The present invention provides a method for treating a textile subjected to high heat dryers of the industrial and institutional sector to impart amine-like softness and reduced yellowing, which method comprises treating the textile with a composition comprising an amino-functional silicone and a quaternary ammonium.

The conditioning benefits of the compositions of the invention are not limited to softening and reduced yellowing, however. The benefits of the present invention can include anti-static properties as well as anti-wrinkling properties. The fabric conditioner composition can include at least one of anti-static agents, anti-wrinkling agents, improved absorbency, dye transfer inhibition/color protection agents, odor removal/odor capturing agents, soil shielding/soil releasing agents, ease of drying, ultraviolet light protection agents, fragrances, sanitizing agents, disinfecting agents, water repellency agents, insect repellency agents, anti-pilling agents, souring agents, mildew removing agents, enzymes, starch agents, bleaching agents, optical brightness agents, allergicide agents, and mixtures thereof.

DETAILED DESCRIPTION OF THE INVENTION

The Fabric Conditioner Composition

Quaternary Ammonium Component

Figure 1:
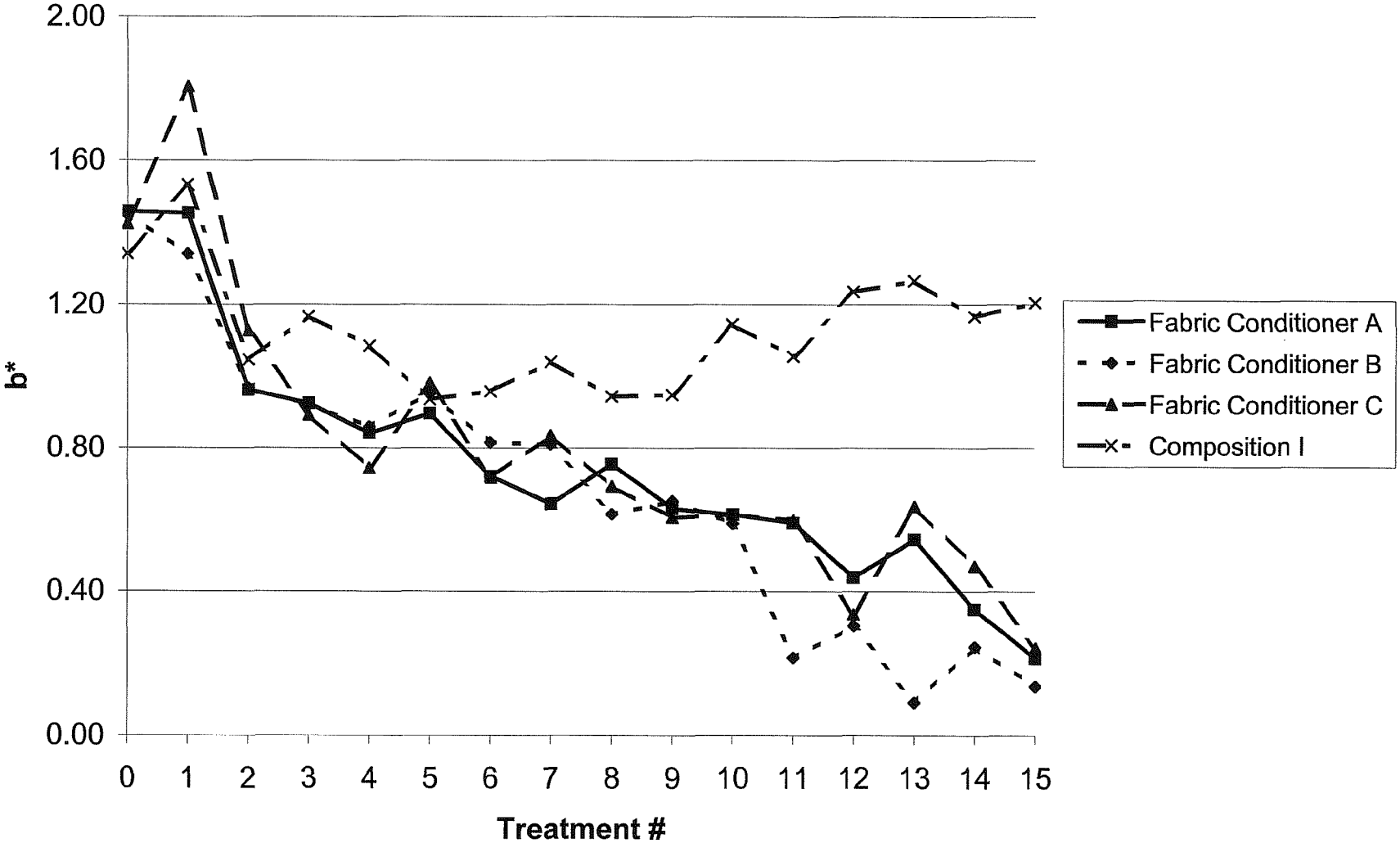
FIG. 1 shows a graph plotting the b* value against the cycle # for a control and three compositions of the invention.

A component of the fabric conditioner composition of the invention is a general type of fabric softener component referred to as a quaternary ammonium compound. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, an alkyl group, a benzyl group, an alkyl ether propyl group, hydrogenated-tallow group, coco group, stearyl group, palmityl group, and soya group. Exemplary ring or cyclic quaternary ammonium compounds include imidazolinium quaternary ammonium compounds and are available under the name Varisoft®. Exemplary imidazolinium quaternary ammonium compounds include methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis(2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477. Exemplary alkoxylated quaternary ammonium compounds include methyl-dialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Accosoft® available from Stepan or Varisoft® available from Evonik Industries. Exemplary amidoamine quaternary ammonium compounds that can be used according to the invention are methyl-bis (tallow amidoethyl)-2-hydroxyethyl ammonium methyl sulfate, methyl bis(oleylamidoethyl)-2-hydroxyethyl ammonium methyl sulfate, and methyl bis(hydr.tallowamidoethyl)-2-hydroxyethyl ammonium methyl sulfate. Exemplary ester quaternary compounds are available under the name Stephantex™.

The quaternary ammonium compounds can include any counter ion that allows the component to be used in a manner that imparts fabric-softening properties according to the invention. Exemplary counter ions include chloride, methyl sulfate, ethyl sulfate, and sulfate.

In certain liquid rinse-added compositions of this invention the amount of active quaternary ammonium component can range from about 2% to about 35%, from about 4% to about 27%, by weight of the total composition, and from about 6% to about 25% of the total composition.

The term "active" as used herein refers to the amount of the component that is present in the composition. As one skilled in the art will recognize, many of the components of the invention are sold as emulsions and the manufacturer will provide data that includes the percentage of active ingredients to the purchaser. As a matter of example only, if 100% of a final composition is comprised of emulsion X and if emulsion X contains 60% of the active component X, we would say that the final composition contained 60% active component X.

Silicone Component

Another component of the fabric conditioning composition of the invention is a silicone compound. The silicone of the invention can be a linear or branched structured silicone polymer. The silicone of the present invention can be a single polymer or a mixture of polymers. Suitable silicones are available from Wacker Chemical and include but are not limited to Wacker® FC 201 which is a high molecular weight polysiloxane and Wacker® FC 205 which is a pre-cross-linked silicone rubber.

Another component of the fabric conditioning composition of the invention is an amino functional silicone. Amino functional silicones are also referred to herein as amino-functional silicones. The amino-functional silicone of the invention can be a linear or branched structured amino-functional silicone polymer. The amino-functional silicone of the present invention can be a single polymer or a mixture of polymers, including a mixture of polymers wherein one of the polymers contains no amino functionality, e.g., a polydimethylsiloxane polymer. Suitable amino-functional silicones are available from Wacker and include Wacker® FC 203 which is an amino functional silicone with polyether groups.

An active amino-functional silicone compound is typically incorporated in the composition of the invention at a level from about 0.2 percent up to about 12 percent by weight. More preferably, the amino-functional silicone component is included at a level of from about 0.5 percent to about 10 percent by weight. Most preferably, the amino-functional silicone component is included at a level of from about 1 percent to about 6 percent by weight.

The present invention can take any of a number of forms. It can take the form of a dilutable fabric conditioner, that may be a liquid, a surfactant-structured liquid, a granular, spray-dried or dry-blended powder, a tablet, a paste, a molded solid or any other fabric conditioner form known to those skilled in the art. A "dilutable fabric conditioning" composition is defined, for the purposes of this disclosure, as a product intended to be used by being diluted with water or a non-aqueous solvent by a ratio of more than 100:1, to produce a liquor suitable for treating textiles and conferring to them one or more conditioning benefits. Water soluble sheets or sachets are also envisaged as a potential form of this invention. These may be sold under a variety of names, and for a number of purposes. For all cases, however, these compositions are intended to be used by being diluted by a ratio of more than 100:1 with water or a non-aqueous solvent, to form a liquor suitable for treating fabrics.

Particularly preferred forms of this invention include conditioner products, especially as a liquid or powder, intended for application as a fabric softener during the wash cycle or the final rinse. For the purposes of this disclosure, the term "fabric softener," "fabric conditioner," or "fabric conditioner" shall be understood to mean an industrial product added to the wash or rinse cycle of a laundry process for the express or primary purpose of conferring one or more conditioning benefits.

It can also take the form of a fabric softener intended to be applied to articles without substantial dilution and sold as any form known to those skilled in the art as a potential medium for delivering such fabric softeners to the industrial and institutional market. Sprays, such as aerosol or pump sprays, for direct application to fabrics are also considered within the scope of this disclosure. Such examples, however, are provided for illustrative purposes and are not intended to limit the scope of this invention.

Fabrics that can be processed according to the invention include any textile or fabric material that can be processed in an industrial dryer for the removal of water. Fabrics are often referred to as laundry in the case of industrial laundry operations. While the invention is characterized in the context of conditioning "fabric," it should be understood that items or articles that include fabric could similarly be treated. In addition, it should be understood that items such as towels, sheets, and clothing are often referred to as laundry and are types of fabrics. Textiles that benefit by treatment of the method of the present invention are exemplified by (i) natural fibers such as cotton, flax, silk and wool; (ii) synthetic fibers such as polyester, polyamide, polyacrylonitrile, polyethylene, polypropylene and polyurethane; and (iii) inorganic fibers such as glass fiber and carbon fiber. Preferably, the textile treated by the method of the present invention is a fabric produced from any of the above-mentioned fibrous materials or blends thereof. Most preferably, the textile is a cotton-containing fabric such as cotton or a cotton-polyester blend. Additional laundry items that can be treated by the fabric treatment composition include athletic shoes, accessories, stuffed animals, brushes, mats, hats, gloves, outerwear, tarpaulins, tents, and curtains. However, due to the harsh conditions imparted by industrial dryers, the laundry items useful for conditioning according to the present invention must be able to withstand the high temperature conditions found in an industrial dryer.

The dryers in which the fabric softener composition according to the invention can be used include any type of dryer that uses heat and/or agitation and/or air flow to remove water from the laundry. An exemplary dryer includes a tumble-type dryer where the laundry is provided within a rotating drum that causes the laundry to tumble during the operation of the dryer. Tumble-type dryers are commonly found in industrial and institutional sector laundry operations.

The compositions of the invention are particularly useful in harsher conditions found in industrial and institutional settings. By the term, "industrial and institutional" it is meant that the operations are located in the service industry including but not limited to hotels, motels, restaurants, health clubs, healthcare, and the like. Dryers in such operations operate at substantially higher temperatures than those found in the consumer or residential market. It is expected that industrial or commercial dryers operate at maximum fabric temperatures that are typically provided in the range of between about 180 degrees Fahrenheit and about 270 degrees F., and consumer or residential dryers often operate at maximum fabric temperatures of between about 120 degrees F. and about 160 degrees F. Industrial and institutional dryers operate in the range of about 180 degrees up to about 270 degrees Fahrenheit, more preferably, about 220 degrees up to about 260 degrees F., and most preferably about 240 degrees up to about 260 degrees Fahrenheit.

Maximum fabric temperature is obtained by placing a temperature monitoring strip into a damp pillowcase. Temperature monitoring strips are sold as Thermolabel available from Paper Thermometer Co, Inc. The pillowcase is then placed into a tumble dryer with a load of damp laundry. Once the load is dry, the temperature monitoring strip is removed from the pillowcase and the maximum recorded temperature is the maximum fabric temperature.

It is generally desirable for laundry that is dried to remain white even after multiple drying cycles. That is, it is desirable that the fabric not yellow after repeated cycles of drying in the presence of the fabric conditioning composition. Whiteness retention can be measured according to b*, for example, a Hunter Lab instrument. In general, it is desirable to exhibit a lower Δb (less yellow) for the fabric treated with the composition of the invention and dried at elevated temperatures, after 15 wash, soften, and drying cycles.

$$\Delta b^* = b^*_{final} - b^*_{initial}.$$

It is generally desirable for fabric treated in a dryer using the fabric conditioning composition of the invention to possess a softness preference that is at least comparable to the softness preference exhibited by commercially available liquid fabric softener. The softness preference is derived from a panel test with one-on-one comparisons of fabric (such as towels) treated with the fabric treatment composition according to the invention or with a commercially available liquid fabric softener. In general, it is desirable for the softness preference resulting from the fabric treatment composition to be superior to the softness preference exhibited by commercially available liquid fabric softener.

Compatible adjuvants can be added to the compositions herein for their known purposes. Such adjuvants include, but are not limited to, viscosity control agents, perfumes, emulsifiers, preservatives, antioxidants, bactericides, fungicides, colorants, dyes, fluorescent dyes, brighteners, opacifiers, freeze-thaw control agents, soil release agents, and shrinkage control agents, and other agents to provide ease of ironing (e.g., starches, etc.). These adjuvants, if used, are added at their usual levels, generally each of up to about 5% by weight of the preferred liquid composition.

The fabric conditioning composition, when it includes an anti-static agent, can generate a static reduction when compared with fabric that is not subjected to treatment. It has been observed that fabric treated using the fabric conditioning composition according to the invention exhibit more constant percent static reduction compared with commercially available liquid softeners.

The fabric conditioning composition can include anti-static agents such as those commonly used in the laundry drying industry to provide anti-static properties. Exemplary anti-static agents include those quaternary compounds mentioned in the context of softening agents. Accordingly, a benefit of using conditioning agents including quaternary groups is that they may additionally provide anti-static properties.

The fabric conditioning composition can include odor capturing agents. In general, odor capturing agents are believed to function by capturing or enclosing certain molecules that provide an odor. Exemplary odor capturing agents include cyclodextrins, and zinc ricinoleate.

The fabric conditioning composition can include fiber protection agents that coat the fibers of fabrics to reduce or prevent disintegration and/or degradation of the fibers. Exemplary fiber protection agents include cellulosic polymers.

The fabric conditioning composition can include color protection agents for coating the fibers of the fabric to reduce the tendency of dyes to escape the fabric into water. Exemplary color protection agents include quaternary ammonium compounds and surfactants. An exemplary quaternary ammonium color protection agent includes di-(nortallow carboxyethyl) hydroxyethyl methyl ammonium methylsulfate that is available under the name Varisoft WE 21 CP from Evonik-Goldschmidt Corporation. An exemplary surfactant color protection agent is available under the name Varisoft CCS-1 from Evonik-Goldschmidt Corporation. An exemplary cationic polymer color protection agent is available under the name Tinofix CL from CIBA. Additional color protection agents are available under the names Color Care Additive DFC 9, Thiotan TR, Nylofixan P-Liquid, Polymer VRN, Cartaretin F-4, and Cartaretin F-23 from Clariant; EXP 3973 Polymer from Alco; and Coltide from Croda.

The fabric conditioning composition can include soil releasing agents that can be provided for coating the fibers of fabrics to reduce the tendency of soils to attach to the fibers. Exemplary soil releasing agents include polymers such as those available under the names Repel-O-Tex SRP6 and Repel-O-Tex PF594 from Rhodia; TexaCare 100 and TexaCare 240 from Clariant; and Sokalan HP22 from BASF.

The fabric conditioning composition can include optical brightening agents that impart fluorescing compounds to the fabric. In general, fluorescing compounds have a tendency to provide a bluish tint that can be perceived as imparting a brighter color to fabric. Exemplary optical brighteners include stilbene derivatives, biphenyl derivatives, and coumarin derivatives. An exemplary biphenyl derivative is distyryl biphenyl disulfonic acid sodium salt. An exemplary stilbene derivative includes cyanuric chloride/diaminostilbene disulfonic acid sodium salt. An exemplary coumarin derivative includes diethylamino coumarin. Exemplary optical brighteners are available under the names Tinopal 5 BM-GX, Tinopal CBS-CL, Tinopal CBS-X, and Tinopal AMS-GX from CIBA. It should be noted, however, that an overall reduction in yellowing is observed when using the composition of the invention in elevated dryer temperatures without the addition of optical brightening agents.

The fabric conditioning composition can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An exemplary UV protection agent includes Tinosorb FD from CIBA.

The fabric conditioning composition can include an anti-pilling agent that acts on portions of the fiber that stick out or away from the fiber. Anti-pilling agents can be available as enzymes such as cellulase enzymes. Exemplary cellulase enzyme anti-pilling agents are available under the names Puradex from Genencor and Endolase and Carezyme from Novozyme.

The fabric conditioning composition can include water repellency agents that can be applied to fabric to enhance water repellent properties. Exemplary water repellents include perfluoroacrylate copolymers, hydrocarbon waxes, and polysiloxanes.

The fabric conditioning composition can include disinfecting and/or sanitizing agents. Exemplary sanitizing and/or disinfecting agents include peracids or peroxyacids. Additional exemplary sanitizing and/or disinfecting agents include quaternary ammonium compounds such as alkyl dimethylbenzyl ammonium chloride, alkyl dimethylethylbenzyl ammonium chloride, octyl decyldimethyl ammonium chloride, dioctyl dimethyl ammonium chloride, and didecyl dimethyl ammonium chloride.

The fabric conditioning composition can include souring agents that neutralize residual alkaline that may be present on the fabric. The souring agents can be used to control the pH of the fabric. The souring agents can include acids such as saturated fatty acids, dicarboxylic acids, and tricarboxylic acids. The souring agents can include mineral acids such as hydrochloric acid, sulfuric acid, phosphoric acid, and HFS acid to name a few.

The fabric conditioning composition can include insect repellents such as mosquito repellents and bed bug repellents/deterrents. An exemplary insect repellent is DEET. Exemplary bed bug deterrents include permethrin, naphthalene, Xylol and ammonia. In addition, the fabric conditioning composition can include mildewcides that kill mildew and allergicides that reduce the allergic potential present on certain fabrics and/or provide germ proofing properties.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the liquid compositions herein, and later to obtain the desired viscosity. The amount of ionizable salts used depends on the amount of active ingredients used in such compositions and can be adjusted according to the desires of the formulator. Typical levels of salts used to control the composition viscosity are from about 20 to about 6,000 parts per million (ppm), preferably from about 20 to about 4,000 ppm by weight of the composition.

Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Stabilizers may be added to the fabric conditioning composition of the invention. Stabilizers such as hydrogen peroxide serve to stabilize preservatives such as Kathon CG/ICP for long term, shelf life stability. Stabilizers may be included in the composition of the invention to control the degradation of preservatives and can range from about 0.05% up to about to 0.1% by weight. Preservatives such as Kathon CG/ICP available from Rohm and Haas may be added to the composition of the invention from about 0.05 weight per cent up to about to 0.15 weight percent. Other preservatives that may be useful in the composition of the invention, which may or may not require use of stabilizers, include but are not limited to Ucaricide available from Dow, Neolone M-10 available from Rohm & Haas, and Korolone B 119 also available from Rohm & Haas.

The fabric conditioning composition may also include perfume. While pro-fragrances can be used alone and simply mixed with essential fabric softening ingredient, most notably surfactant, they can also be desirably combined into three-part formulations which combine (a) a non-fragranced fabric softening base comprising one or more synthetic fabric softeners, (b) one or more pro-fragrant P-keto-esters in accordance with the invention and (c) a fully-formulated fragrance. The latter provides desirable in-package and in-use (wash-time) fragrance, while the pro-fragrance provides a long-term fragrance to the laundered textile fabrics.

In formulating the present fabric conditioning compositions, the fully-formulated fragrance can be prepared using numerous known odorant ingredients of natural or synthetic origin. The range of the natural raw substances can embrace not only readily-volatile, but also moderately-volatile and slightly-volatile components and that of the synthetics can include representatives from practically all classes of fragrant substances, as will be evident from the following illustrative compilation: natural products, such as tree moss absolute, basil oil, citrus fruit oils (such as bergamot oil, mandarin oil, etc.), mastix absolute, myrtle oil, palmarosa oil, patchouli oil, petitgrain oil Paraguay, wormwood oil, alcohols, such as farnesol, geraniol, linalool, nerol, phenylethyl alcohol, rhodinol, cinnamic alcohol, aldehydes, such as citral, Helional™, alpha-hexyl-cinnamaldehyd, hydroxycitronellal, Lilial™ (p-tert-butyl-alpha-methyldihydrocinnamaldehyde), methylnonylacetaldehyde, ketones, such as allylionone, alpha-ionone, beta-ionone, isoraldein (isomethyl-alpha-ionone), methylionone, esters, such as allyl phenoxyacetate, benzyl salicylate, cinnamyl propionate, citronellyl acetate, citronellyl ethoxolate, decyl acetate, dimethylbenzylcarbinyl acetate, dimethylbenzylcarbinyl butyrate, ethyl acetoacetate, ethyl acetylacetate, hexenyl isobutyrate, linalyl acetate, methyl dihydrojasmonate, styrallyl acetate, vetiveryl acetate, etc., lactones, such as gamma-undecalactone, various components often used in perfumery, such as musk ketone, indole, p-menthane-8-thiol-3-one, and methyl-eugenol. Likewise, any conventional fragrant acetal or ketal known in the art can be added to the present composition as an optional component of the conventionally formulated perfume. Such conventional fragrant acetals and ketals include the well-known methyl and ethyl acetals and ketals, as well as acetals or ketals based on benzaldehyde, those comprising phenylethyl moieties. It is preferred that the pro-fragrant material be added separately from the conventional fragrances to the fabric conditioner compositions of the invention.

The preferred pH range of the composition for shelf stability is between about 3 and about 8. The pH is dependent upon the specific components of the composition of the invention. If the quaternary ammonium component is an ester quaternary ammonium, the preferred pH is somewhat lower because the ester linkages may break with higher pHs. As such, it is preferred that compositions of the invention that include ester quaternary ammoniums have a pH in the range of between about 3 and about 6, more preferably in the range of between about 4 and about 5. Amidoamine quaternary ammoniums tolerate a somewhat higher pH and as such compositions of the invention that include amidoamine quaternary ammoniums will likely have a pH in the range of between about 3 and about 8. Because many cationic polymers can decompose at high pH, especially when they contain amine moieties, it is desirable to keep the pH of the composition below the $pK_a$ of the amine group that is used to quaternize the selected polymer, below which the propensity for this to occur is greatly decreased. This reaction can cause the product to lose effectiveness over time and create an undesirable product odor. As such, a reasonable margin of safety, of 1-2 units of pH below the $pK_a$ should ideally be used in order to drive the equilibrium of this reaction to strongly favor polymer stability. Although the preferred pH of the product will depend on the particular cationic polymer selected for formulation, typically these values should be below about 6 to about 8.5. The conditioning bath pH, especially in the case of powdered softener and combination detergent/softener products, can often be less important, as the kinetics of polymer decomposition are often slow, and the time of one conditioning cycle is typically not sufficient to allow for this reaction to have a significant impact on the performance or odor of the product. A lower pH can also aid in the formulation of higher-viscosity products.

A preferred embodiment comprises: a liquid rinse water composition comprising the fabric conditioning composition of the invention.

Embodiments of the Invention

In certain liquid rinse-added compositions of this invention the amount of quaternary ammonium component can range from about 2% to about 35%, from about 4% to about 27%, by weight of the total composition, and from about 6% to about 25% of the total composition.

The levels of amino-functional silicone in such composition can range from about 0.05% to about 40%; from about 0.1% to about 20%; and from about 0.5% to about 15% by weight of the concentrate.

Carriers are liquids selected from the group consisting of water and mixtures of water and short chain $C_1$-$C_4$ monohydric alcohols. The water which is used can be distilled, deionized, and/or tap water. Mixtures of water and up to about 10%, preferably less than about 5%, of short chain alcohol such as ethanol, propanol, isopropanol or butanol, and mixtures thereof, are also useful as the carrier liquid. Carriers that are primarily comprised of water are desirable. Added free water, preferably in the form of deionized water, may be present in the composition of the invention in the amount of up to about 95% by weight, more preferably up to about 80% by weight, and most preferably up to about 60% by weight. The term "added free water" refers to water added to the composition of the invention above and beyond any water that is present in the other individual ingredients.

Some short chain alcohols are present in commercially available quaternary ammonium compound products. Such products can be used in the preparation of preferred aqueous compositions of the present invention. The short chain alcohols are normally present in such products at a level of from about 0.5% to about 10% by weight of the aqueous compositions.

The compositions of the present invention can be prepared by a number of methods. Some convenient and satisfactory methods are disclosed in the following nonlimiting examples.

EXAMPLES

Unless otherwise stated, all wash and rinse procedures were run in a 35 pound Milnor washing machine using 5 grain water.

The Following Towels Scouring Procedure and Wash/Rinse/Dry were Followed for the Low and High Alkaline Washes:

New white cotton terry towels, each having an approximate weight of 0.5 kg, purchased from Institutional Textiles were scoured to remove from the fabric any processing aids used during manufacturing. The scouring was done in a 35 lb. Milnor Washing Machine and was accomplished according to the following procedure.

Scouring Protocol

Step One:

(a) A first low water level wash of about 12 gallons was undertaken for 20 minutes at 130 degrees Fahrenheit. 70 grams L2000XP detergent available from Ecolab of St. Paul, Minn. was used for the first low water level wash. The water was drained from the wash tub.

(b) A second low water level wash of about 12 gallons was undertaken for 10 minutes at 120 degrees Fahrenheit using 70 g L2000XP detergent. The wash water was drained from the tub.

(c) A first high water level rinse of about 15 gallons was undertaken for 3 minutes. The water rinse water temperature was 120 degrees Fahrenheit. The water was drained from the wash tub.

(d) A second high water level rinse of about 15 gallons at 90 degrees Fahrenheit was undertaken for 3 minutes and the water was drained.

(e) A third high water level rinse of about 15 gallons at 90 degrees F. was undertaken for 3 minutes and the water was drained.

(f) A fourth high water level rinse of about 15 gallons at 90 degrees F. was undertaken for 3 minutes and the water was drained.

(g) A five minute extract was undertaken where the wash tub was spun to remove excess water.

Step Two:

Substeps (a) and (b) from Step One were repeated without the addition of the L2000XP detergent.

Substeps (c) through (g)—rinse through extract—from Step One were repeated.

Step Three:

The wet towels were placed in a Huebsch dryer, Stack 30 Pound (300 L) Capacity and the towels were dried on the high setting for 50 to 60 minutes such that the fabric temperature reached about 200 degrees Fahrenheit. If a larger load of towels was scoured, the time was increased. Towels had no remaining free water after Step Three was completed.

Wash/Condition/Dry Cycle

One batch of scoured towels were washed with a low alkaline detergent similar to those found in the residential or consumer market. The low alkaline detergent protocol is provided below. A second batch of scoured towels were washed with a higher alkaline detergent similar to those found in the industrial and institutional sector. The high alkaline detergent protocol is provided below. Samples were put through at least 10 cycles of the wash/condition/dry cycle (Steps One and Two in each protocol) before whiteness and softness results were taken. Both protocols were conducted in a 35 pound washing machine.

While the terms "low alkaline detergent," "mid-pH detergent," and "high alkaline detergent" are used herein, they are for comparative purposes only. For the purpose of this invention, a "high alkaline pH detergent" has a wash pH above about 9, above about 10, or above about 11 or higher. The wash pH refers to the pH of the wash bath.

Low Alkaline Detergent (Wash pH 8):

Step One:

(a) A low water level Wash Step of about 12 gallons was conducted for 7 minutes at 130° F. with 104 g Flexylite detergent available from Ecolab located in St. Paul, Minn.

(b) A low water level Bleach Step of about 12 gallons was conducted for 7 minutes at 130° F. with 100 mL of Laundri Destainer chlorine bleach (about 100 ppm available chlorine) available from Ecolab located in St. Paul, Minn.

(c) A high water level Rinse Step of about 15 gallons was conducted for 2 minutes at 110° F.

(d) A high water level Rinse Step of about 15 gallons was conducted for 2 minutes at 100° F.

(e) A low water level Condition Step of about 12 gallons was conducted for 5 minutes at 100° F. with 32 g Fabric Conditioner. The composition of the Fabric Conditioners are provided below in Tables 1 through 8.

(f) A standard final extract (spin) was conducted for 5 minutes.

Step Two:

The towels were dried for 50-60 minutes until dry. Fabric temperature during the dry step was either conducted at high temperature of 200° F. or greater.

The Following Towels Scouring Procedure and Wash/Rinse/Dry was Followed for the Mid-Range pH Washes:

New white cotton terry towels, each having an approximate weight of 0.5 kg, purchased from Institutional Textiles were scoured to remove from the fabric any processing aids used during manufacturing. The scouring was done in a 35 lb. Unimac Washing Machine and was accomplished according to the following procedure.

Scouring Protocol

Step One:

(a) A first low water level wash of about 12 gallons was undertaken for 15 minutes at 140 degrees Fahrenheit. 100 grams 50% NaOH solution was used for the first low water level wash. The water was drained from the wash tub.

(b) A first high water level rinse of about 15 gallons was undertaken for 2 minutes. The water rinse water temperature was 120 degrees Fahrenheit. The water was drained from the wash tub.

(c) A one minute extract was undertaken where the wash tub was spun at 400 RPM to remove excess water.

(d) A second high water level rinse of about 15 gallons at 110 degrees Fahrenheit was undertaken for 2 minutes and the water was drained.

(e) A five minute extract was undertaken where the wash tub was spun at 400 RPM to remove excess water.

Step Two:

(a) A first low water level wash of about 12 gallons was undertaken for 20 minutes at 130 degrees Fahrenheit using 70 g L2000XP detergent. The wash water was drained from the tub.

(b) A second low water level wash of about 12 gallons was undertaken for 10 minutes at 120 degrees Fahrenheit using 70 g L2000XP detergent. The wash water was drained from the tub.

(c) A first high water level rinse of about 15 gallons was undertaken for 3 minutes. The water rinse water temperature was 120 degrees Fahrenheit. The water was drained from the wash tub.

(d) A second high water level rinse of about 15 gallons at 90 degrees Fahrenheit was undertaken for 3 minutes and the water was drained.

(e) A third high water level rinse of about 15 gallons at 90 degrees F. was undertaken for 3 minutes and the water was drained.

(f) A fourth high water level rinse of about 15 gallons at 90 degrees F. was undertaken for 3 minutes and the water was drained.

(g) A five minute extract was undertaken where the wash tub was spun at 400 RPM to remove excess water.

Step Three:

Substeps (a) through (g) from Step Two were repeated with the addition of the L2000XP detergent.

Substeps (a) through (e)—from Step One were repeated without the addition of 50% NaOH to further rinse the linen.

Step Four:

The wet towels were placed in a Huebsch dryer, Stack 30 Pound (300 L) Capacity and the towels were dried on the high setting for 50 to 60 minutes such that the fabric temperature reached about 200 degrees Fahrenheit. If a larger load of towels was scoured, the time was increased. Towels had no remaining free water after Step Three was completed.

Mid-pH Detergent Protocol (Wash pH 9.7):

Step One:

(a) An Ecolab Formula 1 capsule was docked in a dispenser to create a 10% solution of concentrated product in 5 grain water.

(b) A low water level Wash Step of about 12 gallons was conducted for 15 minutes at 120° F. with 530 g of 10% Formula 1 solution (concentrate product available from Ecolab located in St. Paul, Minn.).

(c) A first high water level rinse of about 15 gallons was undertaken for 2 minutes. The water rinse water temperature was 120 degrees Fahrenheit. The water was drained from the wash tub.

(d) A one minute extract was undertaken where the wash tub was spun at 400 RPM to remove excess water.

(e) A second high water level rinse of about 15 gallons at 110 degrees Fahrenheit was undertaken for 2 minutes and the water was drained.

(f) A five minute extract was undertaken where the wash tub was spun at 400 RPM to remove excess water.

Step Two:

The towels were dried for 60 minutes until dry. Fabric temperature during the dry step was either conducted at high temperature of 200° F.

High Alkaline Detergent Protocol (Wash pH 11.3):

Step One:

(a) A low water level Wash Step of about 12 gallons was conducted for 7 minutes at 130° F. with 50 g colorant-free L2000XP detergent available from Ecolab located in St. Paul, Minn. In an alternate protocol 70 g detergent were used.

(b) A low water level Bleach Step of about 12 gallons was conducted for 7 minutes at 130° F. with 50 mL of Laundri Destainer chlorine bleach (about 50 ppm available chlorine) available from Ecolab located in St. Paul, Minn. In an alternate protocol 100 mL bleach was used.

(c) A high water level Rinse Step of about 15 gallons was conducted for 2 minutes at 110° F.

(d) A high water level Rinse Step of about 15 gallons was conducted for 2 minutes at 100° F.

(e) A high water level Rinse Step of about 15 gallons was conducted for 2 minutes at 100° F.

f) A low water level Condition Step of about 12 gallons was conducted for 5 minutes at 100° F. with 55 g Fabric Conditioner. In an alternate protocol 64 g Fabric Conditioner was used. The compositions of the fabric conditioners are provided below in Tables 1 through 6 below.

(g) A standard final extract (spin) was conducted for 5 minutes.

Step Two:

The towels were dried on high heat for 50-60 minutes until dry. Fabric temperature during the dry step was either conducted at low temperature of less than 180° F. or high temperature of 200° F. or greater.

Softness

Softness was determined by rating from a panel of trained experts. Two towels from each set were evaluated for softness by a panel of seven trained experts. Panelists were asked to rank softness on a 0-7 scale in which 0 is very rough, medium is 3.5, and 7 is very soft. The panelists' rankings for each condition were averaged.

Absorbency

Absorbency was determined by dipping 1 centimeter of 4"×7" test swatches into a colored dye solution and were allowed to stand for 6 minutes. After 6 minutes, the swatches were marked at the highest point of colored dye. The swatches were then measured in millimeters from the 1 cm dip point to the higher line. Each test swatch was repeated three times and the average was reported.

Whiteness Determination

Initial Whiteness readings were taken using a Hunter Lab Colorquest XE spectrophotometer with standardization settings as follows: Mode=RSIN, Viewing Area=Large, Port Size=1.00", and UV Filter=420 nm. HunterLab measuring settings include: Selection: CIELAB, Illuminant: D65, and Observer: 10 degree. Ten scoured towels were read twice each. The 20 readings were averaged.

After the wash, condition, and dry cycles (Steps One and Two) were complete, readings (L, a, b*, WI, YI) were taken for each towel on the Hunter Lab Instrument. This procedure was repeated for a total of 10-15 wash, condition, and dry cycles. A graph of b* versus cycle number was plotted. This shows yellowness of the towels in each progressive wash/condition/dry cycle, with a more positive b* value meaning a more yellow towel. Typically a $\Delta b^* = b^*_{final} - b^*_{initial}$ value is calculated for each variable to factor out differences in initial average readings. Results are shown in FIG. 1. The results show with increasing wash/condition/dry cycles, samples using compositions of the invention (Compositions A, B and C) become less yellow (more white) as compared to a control (Fabric Conditioner Composition I).

Visual Whiteness Data

A trained test panel of seven individuals was asked to choose the whiter towel between two samples. Results are shown as the number of individuals who chose the sample as the whiter towel.

TABLE 1

Basic Fabric Conditioner Composition I

| Raw Material | Percent by weight |
|---|---|
| Water Deionized | 75.521 |
| Poly Ditallow Acyl Methyl Sulfates 90% (Accosoft 501 amidoamine quaternary ammonium) | 23 |

TABLE 1-continued

Basic Fabric Conditioner Composition I

| Raw Material | Percent by weight |
|---|---|
| Calcium Chloride 78% Flake Dihydrate | 0.3 |
| Preservative | 0.15 |
| Fragrance | 1 |

TABLE 2

Basic Fabric Conditioner Composition II

| Raw Material | Percent by weight |
|---|---|
| Water Deionized | 75.521 |
| Stephantex ™ (ester quaternary ammonium) | 23.0 |
| Calcium Chloride 78% Flake Dihydrate | 0.3 |
| Preservative | 0.15 |
| Fragrance | 1 |

TABLE 3

Fabric Conditioner A = Amidoamine quaternary ammonium compound plus an amino-functional silicone compound

| Fabric Conditioner A | Percent by weight |
|---|---|
| Basic Fabric Conditioner I | 90.9 |
| Wacker FC 201 (amino-functional silicone) | 9.1 |

TABLE 4

Fabric Conditioner B = Amidoamine quaternary ammonium compound plus an amino functional silicone with polyether groups

| Fabric Conditioner B | Percent by weight |
|---|---|
| Basic Fabric Conditioner I | 90.9 |
| Wacker FC 203 | 9.1 |

TABLE 5

Fabric Conditioner C = Amidoamine quaternary ammonium compound plus silicone rubber

| Fabric Conditioner C | Percent by weight |
|---|---|
| Basic Fabric Conditioner I | 90.9 |
| Wacker FC 205 | 9.1 |

TABLE 6

Fabric Conditioner D = Ester quaternary ammonium compound plus an amino-functional silicone compound

| Fabric Conditioner D | Percent by weight |
|---|---|
| Basic Fabric Conditioner II | 90.9 |
| Wacker FC 201 | 9.1 |

The following table 7 summarizes data from washing towels pursuant to the low alkaline detergent protocol, using an amido amine quaternary ammonium (Basic Conditioner I) fabric conditioner with and without amino functional silicone (Composition A) and drying under high temperatures as would be experienced in an industrial setting.

TABLE 7

| Detergent | Conditioner | Dryer Temperature (degrees Fahrenheit) | Silicone | Δb value | Visual Whiteness (# of individuals choosing sample as whitest) |
|---|---|---|---|---|---|
| Low Alkaline | Basic Conditioner I (Control) | High - 245 F. | No | 0.41 | 6 |
| Low Alkaline | Conditioner A | High - 245 F. | Yes | −0.02 | 16 |
| Low Alkaline | Basic Conditioner I (Control) | High - 200 F. | No | −0.09 | — |
| Low Alkaline | Conditioner A | High - 200 F. | Yes | −0.92 | — |

The following table 8 summarizes data from washing towels pursuant to the high alkaline detergent protocol, using an amido amine quaternary ammonium (Basic Conditioner I) fabric conditioner with and without amino functional silicone (Composition A) and drying under low and high temperatures. A high alkaline detergent is used in industrial settings. For the samples shown in Table 8, a colorant-free detergent was used. The commercially available detergent includes a blue colorant that might have altered the results. Even when using the high alkaline detergent and drying under lower or consumer dryer conditions (lower temperature) a benefit was seen when practicing the invention. Samples were also more absorbent when treated according to the invention (Conditioner with silicone).

TABLE 8

| Detergent | Conditioner | Protocol Conditions (g detergent/ml bleach/g conditioner) | Dryer Condition (degrees Fahrenheit) | Silicone | Δb-value | Softness retention | Absorbancy |
|---|---|---|---|---|---|---|---|
| High Alkaline | Basic Conditioner I (Control) | 70 g/100 ml/64 g | Low - 150 F. | No. | −0.04 | — | — |
| High Alkaline | Conditioner A | 70 g/100 ml/64 g | Low - 150 F. | Yes | −0.94 | — | — |
| High Alkaline | Basic Conditioner I (Control) | 50 g/50 ml/55 g | High - 200 F. | No | −0.68 | 5.2 | 2.5 |
| High Alkaline | Conditioner A | 50 g/50 ml/55 g | High - 200 F. | Yes | −1.00 | 5.6 | 5.1 |
| High Alkaline | Basic Conditioner I (Control) | 50 g/50 ml/55 g | High - 240 F. | No | 0.12 | 5.3 | 2.7 |
| High Alkaline | Conditioner A | 50 g/50 ml/55 g | High - 240 F. | Yes | −0.57 | 6.2 | 5.1 |
| High Alkaline | Basic Conditioner I (Control) | 70 g/100 ml/64 g | High - 245 F. | No | 0.94 | — | — |
| High Alkaline | Conditioner A | 70 g/100 ml/64 g | High - 245 F. | Yes | 0.29 | — | — |

with Visual Whiteness Data for select repeated samples

| Detergent | Conditioner | Protocol Conditions (g detergent/ml bleach/g conditioner) | Dryer Condition (degrees Fahrenheit) | Silicone | Δb value | Visual Whiteness (# of individuals choosing sample as whitest) |
|---|---|---|---|---|---|---|
| High Alkaline | Basic Conditioner I (Control) | 70 g/100 ml/64 g | Low - 150 F. | No | −0.04 | 2 |
| High Alkaline | Conditioner A | 70 g/100 ml/64 g | Low - 150 F. | Yes | −0.94 | 20 |
| High Alkaline | Basic Conditioner I (Control) | 70 g/100 ml/64 g | High - 245 F. | No | 0.94 | 6 |
| High Alkaline | Conditioner A | 70 g/100 ml/64 g | High - 245 F. | Yes | 0.29 | 16 |

The following table 9 summarizes data from washing towels pursuant to the low alkaline detergent protocol, using an ester quaternary ammonium (Basic Conditioner II) fabric conditioner with and without amino functional silicone (Composition D) and drying under high temperatures.

TABLE 9

| Detergent | Conditioner | Dryer Temperature (degrees F.) | Silicone | Δb value | Softness retention |
|---|---|---|---|---|---|
| Low Alkaline | Basic Composition II (Control) | High - 200 F. | No | 0.22 | 5.1 |
| Low Alkaline | Composition D | High - 200 F. | Yes | −0.24 | 5.9 |
| Low Alkaline | Basic Composition II (Control) | High - 240 F. | No | 0.76 | 5.2 |
| Low Alkaline | Composition D | High - 240 F. | Yes | 0.41 | 5.6 |

The following table 10 summarizes data from washing towels pursuant to the low alkaline detergent protocol, using an amidoamine quaternary ammonium (Basic Conditioner I) fabric conditioner with and without amino functional silicone (Composition B) and with and without silicone rubber (Composition C) and drying under high temperatures.

TABLE 10

| Detergent | Conditioner | Dryer Temperature (degrees Fahrenheit) | Silicone | Δb value | Softness retention |
|---|---|---|---|---|---|
| Low Alkaline | Basic Conditioner I (Control) | High - 200 F. | No | −0.09 | — |
| Low Alkaline | Composition B | High - 200 F. | Yes | −1.09 | — |
| Low Alkaline | Basic Conditioner I (Control) | High - 200 F. | No | −0.09 | — |
| Low Alkaline | Composition C | High - 200 F. | Yes | −1.00 | — |

The following table 11 summarizes data from washing towels pursuant to the mid pH detergent protocol, using an amidoamine quaternary ammonium (Basic Conditioner I) fabric conditioner with and without amino functional silicone (Composition A) and drying under high temperatures.

TABLE 11

| Detergent | Conditioner | Dryer Temperature (degrees Fahrenheit) | Silicone | # of wash/dry cycles | Whiteness (# of individuals choosing sample as whitest) | Softness retention | Δb value |
|---|---|---|---|---|---|---|---|
| mid-pH | Conditioner I | 200 F. | No | 10 | — | — | 3.55 |
| mid-PH | Composition A | 200 F. | Yes | 10 | — | — | 0.21 |
| mid-pH | Conditioner I | 200 F. | No | 15 | 0 | 4.38 | 4.12 |
| mid-PH | Composition A | 200 F. | Yes | 15 | 22 | 4.37 | 1.12 |

The above data summarized in Tables 7-11 shows that reduced yellowing of samples occurred when compositions of the invention were used in high or mid-alkaline wash conditions and/or when dryer temperature was 200° F. or higher. The above data also shows that softness did not decrease in the samples using a conditioner of the invention.

We claim:

1. Method of conditioning fabrics, comprising:

(a) contacting cotton fabric with a liquid composition comprising consisting of an amino-functional silicone, an amidoamine quaternary ammonium, water, salt, viscosity controlling agent and fragrance; and (b) drying said fabric so that the fabric temperature is 200 degrees F. or greater;

wherein the delta b* of cotton fabric is greater (more negative) than the delta b* of a control when subjected to at least 15 cycles, a cycle is comprised of a wash step followed by a conditioning step according to step (a) and drying step according to step (b) and the softness of the fabric does not decrease.

2. The method of conditioning fabric according to claim 1 comprising a step of washing the fabric in a wash pH greater than 9 before contacting the fabric with the fabric conditioning composition.

3. Method of conditioning fabrics, comprising:

(a) washing cotton fabric with a wash pH greater than 9, (b) contacting the washed fabric with a composition consisting of an amino-functional silicone, an amidoamine quaternary ammonium, water, salt, viscosity controlling agent and fragrance; and (c) drying said fabric so that the fabric temperature is 200 degrees F. or greater, wherein the delta b* of cotton fabric is greater (more negative) than the delta b* of a control when subjected to at least 15 cycles, a cycle is comprised of a wash step according to step (a) followed by a conditioning step according to step (b) and drying step according to step (c) and the softness of the fabric does not decrease.

4. A method of treating fabric, the method comprising: (a) allowing cotton fabric to contact a liquid fabric conditioning composition, wherein said composition consists of: (i) an amidoamine quaternary ammonium compound; (ii) an amino-functional silicone compound; (iii) water; (iv) salt; (v) viscosity controlling agent and (vi) fragrance; and (b) subjecting said conditioned fabric to the inside of an industrial dryer during a drying operation wherein the fabric temperature is 200 degrees Fahrenheit or greater, and the delta b* of said fabric is greater (more negative) than the delta b* of a control after 15 cycles, wherein a cycle comprises a wash step, a treating step according to step (a), and a drying step according to step (b).

5. The method according to claim 4, wherein the softness of the treated fabric does not decrease.

6. Method of conditioning fabrics, comprising:

(a) washing cotton fabric in a high alkaline detergent;

(b) contacting the cotton fabric with a liquid composition consisting of an amino-functional silicone, and amidoamine quaternary ammonium, water, salt, viscosity controlling agent and fragrance; and (c) drying said fabric at a temperature of greater than 200 degrees F., wherein the delta b* of cotton fabric is greater (more negative) than the delta b* of a control when subjected to at least 15 cycles, a cycle is comprised of a wash step according to step (a) followed by a conditioning step according to step (b) and drying step according to step (c) and the softness of the fabric does not decrease.

7. The method of conditioning fabric according to claim 6 comprising a step of washing the fabric in a wash pH greater than 9 before contacting the fabric with the fabric conditioning composition.

8. Method of conditioning fabrics, comprising:

(a) washing cotton fabric with a wash pH greater than 10, (b) contacting the washed fabric with a composition consisting of an amino-functional silicone, an amidoamine quaternary ammonium, water, salt, viscosity controlling agent and fragrance; and (c) drying said fabric at a temperature of greater than 200 degrees F., wherein the delta b* of cotton fabric is greater (more negative) than the delta b* of a control when subjected to at least 15 cycles, a cycle is comprised of a wash step according to step (a) followed by a conditioning step according to step (b) and drying step according to step (c) and the softness of the fabric does not decrease.

* * * * *